US009156482B2

(12) United States Patent
Kanner et al.

(10) Patent No.: US 9,156,482 B2
(45) Date of Patent: Oct. 13, 2015

(54) LOCATOR LOOP CONTROL SYSTEM AND METHOD OF USING THE SAME

(71) Applicant: Thales Canada Inc, Toronto, Ontario (CA)

(72) Inventors: Abe Kanner, Mississauga (CA); Firth Whitwam, Toronto (CA); Mohammed El-Azizy, Toronto (CA); Philip Chorazy, Whitby (CA)

(73) Assignee: Thales Canada Inc, Toronto, Ontario (CA)

( * ) Notice: Subject to any disclaimer, the term of this patent is extended or adjusted under 35 U.S.C. 154(b) by 0 days.

(21) Appl. No.: 13/968,944

(22) Filed: Aug. 16, 2013

(65) Prior Publication Data

US 2015/0051761 A1 Feb. 19, 2015

(51) Int. Cl.

| | |
|---|---|
| ***B61L 27/00*** | (2006.01) |
| ***B61L 99/00*** | (2006.01) |
| ***B61L 3/12*** | (2006.01) |
| ***B61L 3/22*** | (2006.01) |
| ***B61L 25/02*** | (2006.01) |

(52) U.S. Cl.

CPC ..... *B61L 27/0005* (2013.01); *B61L 3/121* (2013.01); *B61L 3/227* (2013.01); *B61L 25/025* (2013.01); *B61L 27/0038* (2013.01); *B61L 99/00* (2013.01)

(58) Field of Classification Search

CPC ... B61L 2026/005; B61L 21/10; B61L 25/26; B61L 3/008; B61L 23/005; B61L 27/0027; B61L 27/0038; B61L 27/04; B61C 17/12; B61C 1/00; B61C 11/00

USPC ..... 701/19, 20, 29.1; 246/167 R, 122 R, 246/192 R

See application file for complete search history.

(56) References Cited

U.S. PATENT DOCUMENTS

| | | | | |
|---|---|---|---|---|
| 4,965,583 | A * | 10/1990 | Broxmeyer | 342/42 |
| 5,533,695 | A | 7/1996 | Heggestad et al. | |
| 5,828,979 | A | 10/1998 | Polivka et al. | |
| 8,509,971 | B1 * | 8/2013 | Isailovski et al. | 701/20 |
| 2005/0076716 | A1 * | 4/2005 | Turner | 73/579 |
| 2010/0236445 | A1 * | 9/2010 | King et al. | 104/130.03 |
| 2010/0258682 | A1 * | 10/2010 | Fries et al. | 246/1 C |
| 2010/0299007 | A1 * | 11/2010 | Ghaly | 701/20 |
| 2012/0221181 | A1 * | 8/2012 | Rosener | 701/20 |
| 2013/0024054 | A1 | 1/2013 | Katsuta et al. | |

FOREIGN PATENT DOCUMENTS

| | | |
|---|---|---|
| CA | 2156026 | 2/1996 |
| EP | 2548785 | 1/2013 |

OTHER PUBLICATIONS

International Search Report for corresponding International Application No. PCT/IB2014/063398, dated Oct. 21, 2014.

* cited by examiner

*Primary Examiner* — Marthe Marc-Coleman
(74) *Attorney, Agent, or Firm* — Hauptman Ham, LLP

(57) ABSTRACT

A locator loop control system includes a guideway configured to define a travel path of a vehicle. The locator loop control system further includes a locator loop located along the guideway, the locator loop configured to exchange information with a vital on-board controller (VOBC) on-board the vehicle. The locator loop control system further includes a first proximity plate located along the guideway, the first proximity plate spaced a first distance along the guideway from the locator loop, and a wayside controller configured to communicate with the locator loop.

20 Claims, 4 Drawing Sheets

202a
202b
206
208a
208b
208c 202a
202b
206
208a
208b
208c 202a
202b
208a
208b
208c

LOCATOR LOOP CONTROL SYSTEM AND METHOD OF USING THE SAME

BACKGROUND

A vehicle traveling within a guideway network is connected to a primary control system configured to provide movement instructions to the vehicle. The vehicle also includes a redundant control system configured to provide movement instructions to the vehicle in case the primary control system fails or communication with the primary control system is interrupted. The redundant control system is not activated until a problem arises with respect to the primary control system. In some instances, the redundant control system is manually operated by a driver on-board the vehicle. In some instances, if a problem arises with the primary control system, the vehicle brakes to a stop until the driver can be transported to the vehicle to begin manual operation.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
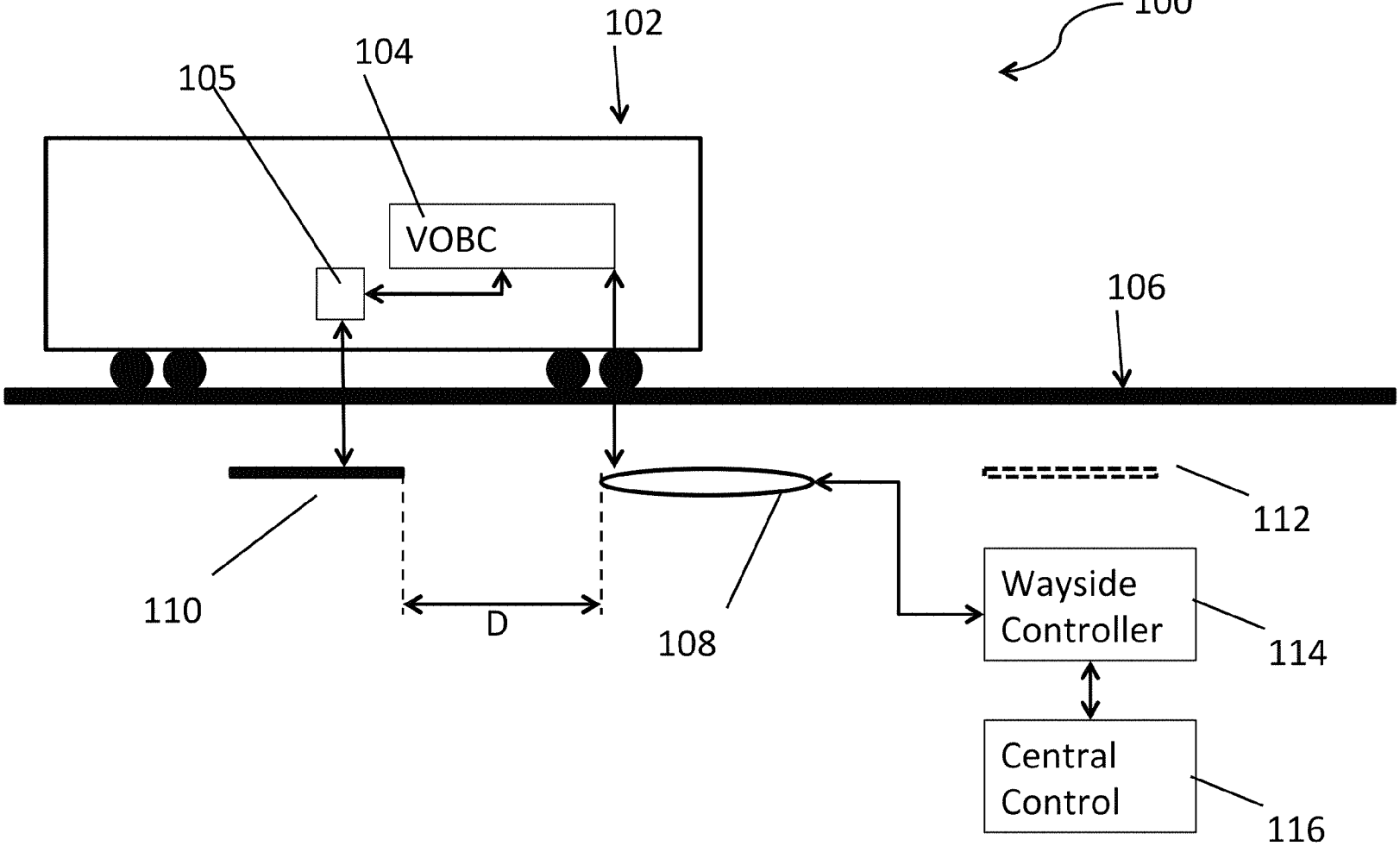
FIG. 1 is a high level diagram of a locator loop control system in accordance with one or more embodiments.

FIG. 1 is a high level diagram of a locator loop control system 100 in accordance with one or more embodiments. Locator loop control system 100 includes a vehicle 102 having a vital on-board controller (VOBC) 104. A sensor 105 is also mounted on vehicle 102 and is connected to VOBC 104. Vehicle 102 travels along a guideway 106. A locator loop 108 is located along guideway 106. A proximity plate 110 is located along guideway 106 and is spaced a distance D from locator loop 108. In some embodiments where bi-directional travel is permitted along guideway 106, locator loop control system 100 includes a second proximity plate 112. In some embodiments where travel is permitted in a single direction along guideway 106, proximity plate 112 is omitted. In some embodiments, second proximity plate is located on a downstream side of the locator loop control system 100 from proximity plate 110. A wayside controller 114 is in communication with locator loop 108. Wayside controller 114 is also in communication with a central control system 116.

Vehicle 102 is configured to travel along guideway 106. In some embodiments, vehicle 102 is configured to carry passengers. In some embodiments, vehicle 102 is configured to carry freight. In some embodiments, vehicle 102 is capable of being remotely operated by a driver not present on the vehicle.

VOBC 104 is configured to receive movement instructions including a maximum vehicle speed and a limit of movement authority. VOBC 104 is also configured to calculate a position on the guideway of vehicle 102. In some embodiments, VOBC 104 calculates the position of vehicle 102 by comparing a stored guideway database with data received from wayside devices, central control 116, track mounted devices, on-board positioning systems or other suitable devices. VOBC 104 stores the position information on a non-transitory computer readable medium.

VOBC 104 is also configured to communicate with external components, such as locator loop 108, wayside controller 114 or central control 116. VOBC 104 is configured to receive and transmit information using radio communication, infrared communication, microwave communication, inductive loop communication, optical communication or other suitable communication methods. VOBC 104 is configured to transmit vehicle identification information, position information, vehicle status information or other relevant information. VOBC 104 is configured to receive position information, movement instructions, updates to the stored guideway database, positional information for other vehicles on guideway 106 or other relevant information.

VOBC 104 is connected to an automatic speed control which is configured to adjust and monitor the speed of vehicle 102. In some embodiments, VOBC 104 is integrated with the automatic speed control so that the VOBC directly controls a thrust and braking of vehicle 102. VOBC 104 is capable of generating speed control signals for controlling the automatic speed control to apply brakes or increase the speed of vehicle 102.

In some embodiments, VOBC 104 is implemented by running a background process on every vital machine having safety integrity level 4 (SIL 4) in the system which listens to communication traffic and collects key data as identified by a configuration profile of the VOBC. In some embodiments, SIL 4 is based on International Electrotechnical Commission's (IEC) standard IEC 61508. SIL level 4 means the probability of failure per hour ranges from $10^{-8}$ to $10^{-9}$.

Sensor 105 is mounted on vehicle 102 and is configured to detect proximity plate 110. Sensor 105 is connected to VOBC 104 and is configured to provide a detection signal to the VOBC upon detection of proximity plate 110. In some embodiments, sensor 105 is a Hall Effect Sensor or another suitable type of magnetic metal detector.

Guideway 106 is configured to control a travel path of vehicle 102. In some embodiments, guideway 106 is a split rail guideway including two rails spaced apart from one another. In some embodiments, guideway 106 is a monorail guideway including a single rail. In some embodiments, guideway 106 includes cross-overs to facilitate vehicle 102 switching from guideway 106 to a different guideway.

Locator loop 108 is configured to provide communication between VOBC 104 and wayside controller 114. In some embodiments, locator loop 108 is located between rails of a split rail guideway. In some embodiments, locator loop 108 is located outside rails of a split rail guideway. In some embodiments, locator loop 108 is located adjacent to guideway 106 for monorail systems.

Locator loop 108 includes a coil configured to transmit or receive information from VOBC 104 and wayside controller 114. An area in which the coil is capable of receiving or transmitting information is an information transmitting/receiving area of locator loop 108. In some embodiments, the coil is mounted on a board such as a fiberglass board to provide a solid base for locator loop 108. In some embodiments, locator loop 108 is mounted on a bracket attached to guideway 106 to help align the locator loop with an antenna attached to vehicle 102. In some embodiments, locator loop 108 includes an antenna. In some embodiments, the antenna includes a multi-core cable attached to the coil. In some embodiments, locator loop 108 includes multiple coils connected by a communication cable. The multiple coils allow an increase in the carrier signal for information transmitting/receiving area of locator loop 108. In some embodiments, locator loop 108 includes a cable connected to wayside controller 114. In some embodiments, locator loop 108 is wirelessly connected to wayside controller 114.

Proximity plate 110 is a magnetic plate configured to be detected by sensor 105 attached to the vehicle 102. VOBC 104 is connected to sensor 105 and is configured to receive a detection signal when the sensor detects proximity plate 110. Proximity plate 110 is configured to alert VOBC 104 of an approaching locator loop 108. Proximity plate 110 includes a magnetic material, such as iron, unfinished steel or another suitable magnetic material. In some embodiments, proximity plate 110 is located between rails of a split rail guideway. In some embodiments, proximity plate 110 is located adjacent to guideway 106 for monorail systems. In some embodiments, proximity plate 110 is located outside rails of a split rail guideway. In some embodiments, proximity plate 110 is mounted in a same manner as locator loop 108. In some embodiments, proximity plate 110 has a length ranging from about 1 meter to about 1.5 meters. In some embodiments, proximity plate 110 has a width ranging from about 30 centimeters (cm) to about 50 cm. In still further embodiments, proximity plate 110 has different dimensions suitable for detection by sensor 105 given a particular rate of travel of vehicle 102. Proximity plate 110 is separated from locator loop by distance D. Distance D is determined based on a maximum allowed speed along guideway 106. A time duration in which locator loop 108 is able to exchange information with VOBC 104 is determined by the information transmitting/receiving area of the locator loop, a speed of vehicle 102 and a polling rate of the locator loop by wayside controller 114. As vehicle 102 travels faster, the time duration decreases. As the information transmitting/receiving area of locator loop 108 increases, the time duration increases. In some embodiments, distance D ranges from about 3 meters (m) to about 4 m. In some embodiments, VOBC 104 controls the automatic speed control system to decrease the speed of vehicle 102 upon detecting proximity plate 110 in order to increase the time duration for exchanging information between the VOBC and locator loop 108.

Proximity plate 112 is included in an arrangement where bi-directional travel is permitted on guideway 106. In some embodiments where travel is permitted in a single direction on guideway 106, proximity plate 112 is omitted. In some embodiments, proximity plate 112 has a same material and dimensions as proximity plate 110. In some embodiments, proximity plate 112 has a different material or dimensions from proximity plate 110 for distinguishing a direction of travel of vehicle 102 along guideway 106. In some embodiments, proximity plate 112 has a length ranging from about 1 meter to about 1.5 meters. In some embodiments, proximity plate 112 has a width ranging from about 30 centimeters (cm) to about 50 cm. In still further embodiments, proximity plate 112 has different dimensions suitable for detection by sensor 105 given a particular rate of travel of vehicle 102. In some embodiments, proximity plate 112 has a same length or width as proximity plate 110. In some embodiments, proximity plate 112 has a different length and width from proximity plate 110. In some embodiments, a distance between proximity plate 112 and locator loop 108 is equal to distance D. In some embodiments, the distance between proximity plate 112 and locator loop 108 is different from distance D for distinguishing a direction of travel of vehicle 102 along guideway 106.

Wayside controller 114 is configured to communicate with VOBC 104 through locator loop 108. In some embodiments, the polling rate of wayside controller 114 ranges from about 200 milliseconds (ms) to about 500 ms. In some embodiments, the polling rate is faster than 200 ms. In some embodiments, the polling rate is slower than 500 ms. The polling rate is the rate at which wayside controller 114 exchanges information with locator loop 108. In some embodiments, a single wayside controller 114 is connected to multiple locator loops 108. In some embodiments, wayside controller 114 is connected to a single locator loop 108. Wayside controller 114 is in communication with central control 116 to provide the central control with updated information relating to vehicle 102. In some embodiments, wayside controller 114 is configured to relay information from central control 116 to VOBC 104. In some embodiments, wayside controller 114 is configured to generate instructions independent from central control 116 and transmit those instructions to VOBC 104. In some embodiments, wayside controller 114 has a wired connection to central control 116. In some embodiments, wayside controller 114 has a wireless connection to central control 116.

Central control 116 is configured to receive the information related to vehicle 102 as well as other vehicles in a guideway system including guideway 106. In some embodiments, central control 116 is configured to receive information regarding vehicle 102 via wayside controller 114. Centralized control 106 is also configured to receive vehicle position and speed information from VOBC 104. In some embodiments, a communication path between central control 116 and VOBC 104 is independent from a communication path between wayside controller 114 and the VOBC. Central control 116 is also configured to generate movement instructions for vehicle 102. In some embodiments, a single central control 116 is used for an entire guideway network. In some embodiments, central control 116 is configured to provide instructions for a portion of the guideway network covering more than one wayside controller 114.

In operation, vehicle 102 travels along guideway 106 in a direction so as to encounter proximity plate 110 prior to locator loop 108. During normal operation, VOBC 104 communicates directly to wayside controller 114 or central control 116 via a primary communication system. In instances where the primary communication system fails or is interrupted, VOBC 104 begins communicating with wayside controller 114 or central control 116 using locator loop control system 100 until the primary communication system is re-established or repaired. VOBC 104 stores the positional information of vehicle 102 and a guideway database for guideway 106. Based on this information, VOBC 104 is able to determine a location and distance of the next locator loop 108 along guideway 106. VOBC 104 also stores a most recent set of instructions received from wayside controller 114 or central control 116 through the primary communication system.

In some embodiments, when the primary communication fails VOBC 104 permits vehicle 102 to travel at low speed in the commanded travel direction to continue along guideway 106 until the vehicle reaches the next locator loop 108. In some embodiments, VOBC 104 transmits instructions to the automatic speed control system to reduce the speed of vehicle 102 when the primary communication system fails or is interrupted. VOBC 104 begins transmitting a signal to be reflected by proximity plate 110. Sensor 105 detects the presence of proximity plate 110 (112) and transmits the detection signal to VOBC 104. Upon detection of proximity plate 110, VOBC 104 begins to "announce" vehicle 102 to locator loop 108. In some embodiments, VOBC 104 transmits instructions to the automatic speed control system to reduce the speed of vehicle 102 upon detection of proximity plate to increase the time duration for exchanging information with locator loop 108. VOBC 104 "announces" vehicle 102 by transmitting vehicle identification information and position information stored on the VOBC to locator loop 108. In some embodiments, VOBC 104 "announces" vehicle 102 using a coded frequency specific to locator loop 108. VOBC 104 knows the specific coded frequency for locator loop 108 based on information in the stored guideway database.

As vehicle 102 passes or stops on locator loop 108, VOBC 104 and locator loop exchange information such as vehicle position, updated movement instructions, distance to a next locator loop or other relevant information. In some embodiments, if locator loop 108 does not have a new set of movement instructions for vehicle 102, VOBC 104 will continue to follow the most recent set of instructions received via the primary communication system until a limit of movement authority of the most recent set of instructions is reached. In some embodiments, if locator loop 108 does not have a new set of movement instructions or if the limit of movement authority of the most recent set of instructions received via the primary communication system does not allow movement of the vehicle to a next locator loop, VOBC 104 provides a signal to automatic speed control system to brake vehicle 102 to a stop.

The time duration for exchanging information between VOBC 104 and locator loop 108 depends on the speed of vehicle 102 and the information transmitting/receiving area of the locator loop as well as a polling rate of wayside controller 114. For example, in an arrangement where the polling rate of wayside controller is 500 ms and vehicle 102 is traveling at 30 kilometers per hour (km/h), the information transmitting/receiving area of locator loop should be about 4.2 m long in order to provide sufficient time for information exchange between VOBC 104 and the locator loop and between the locator loop and the wayside controller. In another example, in an arrangement where the information transmitting/receiving area of locator loop 108 is 1.4 m long and the polling rate of wayside controller 114 is 500 ms, the speed of vehicle 102 should be about 10 km/h to provide sufficient time for information exchange. In still another example, in an arrangement where the information transmitting/receiving area of locator loop 108 is 1.4 m long and the speed of vehicle 102 is 30 km/h, the polling rate of wayside controller 114 should be about 168 ms to provide sufficient time for information exchange. In instances where locator loop 108 provides new instructions to VOBC 104, the VOBC executes the new instructions received from the locator loop because the locator loop is a trusted system. In embodiments where vehicle 102 includes a human driver, the new instructions are communicated to the driver by VOBC 104 through a system internal to vehicle 102. In some embodiments, the new instructions are communicated to the driver using a display module, an auditory module or another suitable communication method. In some embodiments, locator loop 108, wayside controller 114 or central control 116 do not provide an external indication of the new instructions to the human driver. If the human driver attempts to override the instructions received from locator loop 108, VOBC 104 sends a signal to the automatic speed control system to active the brakes, to bring vehicle 102 to a stop.

Figures 2A, 2B, 2C:
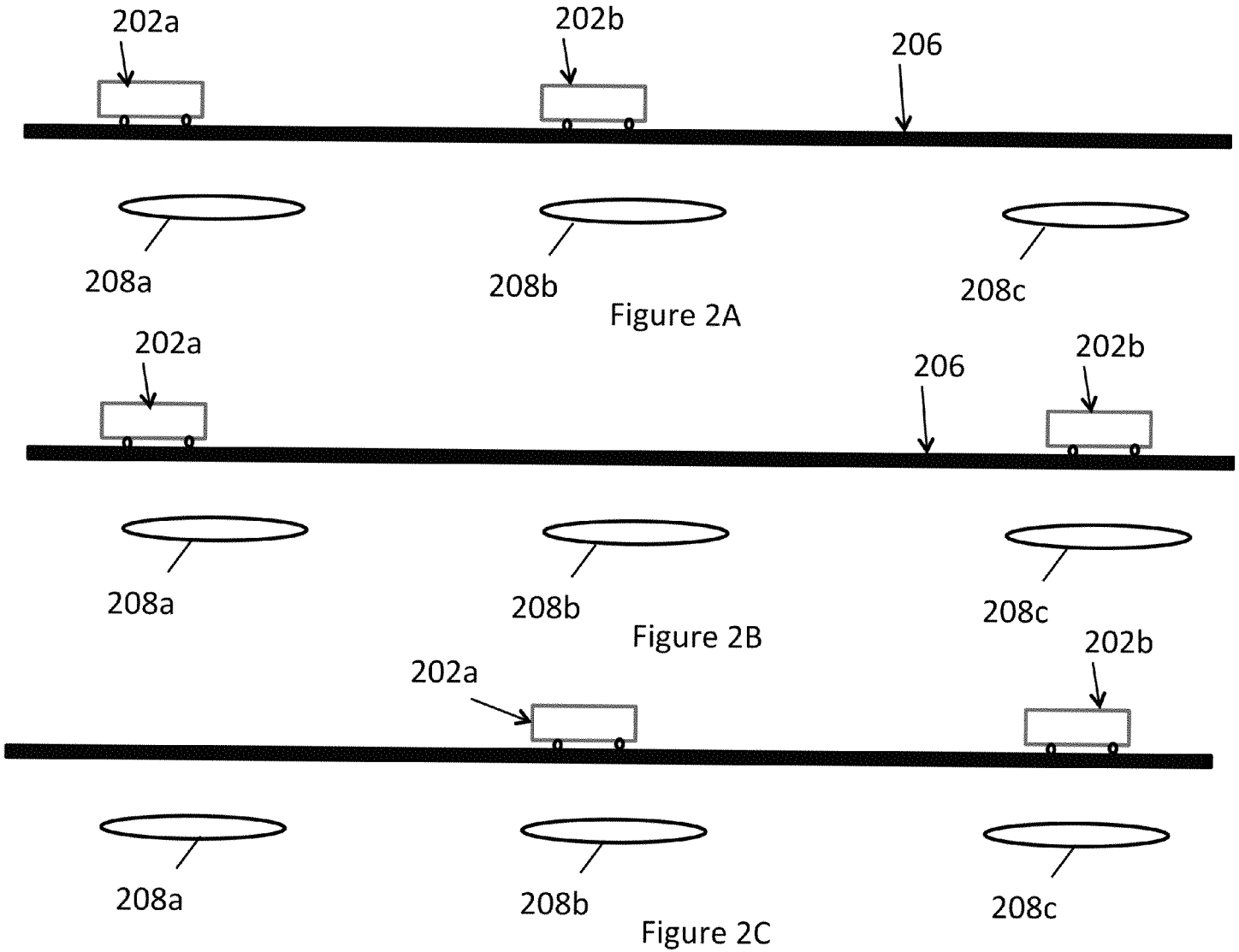
FIGS. 2A-2C are high level diagrams of a control operation using a locator loop control system in accordance with one or more embodiments.

FIGS. 2A-2C are high level diagrams of a control operation using a locator loop control system in accordance with one or more embodiments. In the arrangement of FIGS. 2A-2C, a first vehicle 202*a* and a second vehicle 202*b* are traveling along a guideway 206 having multiple locator loops 208*a*-*c*. Second vehicle 202*b* is a lead vehicle. A primary communication system of first vehicle 202*a* fails or is interrupted. Upon failure of the primary communication system of first vehicle 202*a*, a no turnaround signal is transmitted to second vehicle 202*b* instructing the second vehicle that a change in direction along guideway 206 is not permitted. In some embodiments, the no turnaround signal is sent to second vehicle 202*b* if guideway 206 permits bi-directional travel. In some embodiments, the no turnaround signal is sent to second vehicle 202*b* regardless of whether bi-directional travel is permitted along guideway 206.

First vehicle 202*a* continues along guideway 206 until the first vehicle encounters locator loop 208*a*. A VOBC on-board first vehicle 202*a* exchanges information with locator loop 208*a*. Locator loop 208*a* provides movement instructions to first vehicle 202*a* related to movement authority and vehicle speed. Locator loop 208*a* issues movement authorization for a portion of guideway 206 between locator loop 208*a* and locator loop 208*b*. Locator loop 208*a* does not authorize first vehicle 202*a* to pass locator loop 208*a* until second vehicle 202*b* has passed locator loop 208*b*. Locator loop 208*a* is able to determine a location of second vehicle 202*b* through information received through a wayside controller, e.g., wayside controller 114 (FIG. 1), or through a central control system, e.g., central control 116. In the arrangement of FIG. 2A, second vehicle 202*b* has not pass locator loop 208*b*, so locator loop 208*a* will instruct first vehicle 202*a* to stop.

In the arrangement of FIG. 2B, second vehicle 202*b* has passed locator loop 208*b*. The portion of guideway 206 between locator loop 208*a* and locator loop 208*b* is free of vehicles. Locator loop 208*a* issues instructions to first vehicle 202*a* permitting continued movement to locator loop 208*b*. The instructions provided by locator loop 208*a* include a limit of movement authority, a maximum vehicle speed and a distance to locator loop 208*b*. In embodiments where first vehicle 202*a* includes a human driver, if the driver attempts over override the instructions from locator loop 208*a*, the VOBC of first vehicle 202*a* will instruct an automatic speed control system of the first vehicle to brake the first vehicle to a stop.

In the arrangement of FIG. 2C, first vehicle 202*a* reached locator loop 208*b*, but second vehicle 202*b* has not passed locator loop 208*c*. Locator loop 208*b* provides instructions to first vehicle 202*a* to stop until guideway 206 between locator loop 208*b* and locator loop 208*c* is free of other vehicles.

In the arrangement of FIGS. 2A-2C, locator loops 208*a*-*c* are provided along a continuous stretch of guideway 206. In some embodiments, locator loops are located at entrances to cross-overs in a guideway network, stations, landmarks or other locations within the guideway network where vehicle movement authority is limited or a position of the vehicle is desired.

Figure 3:
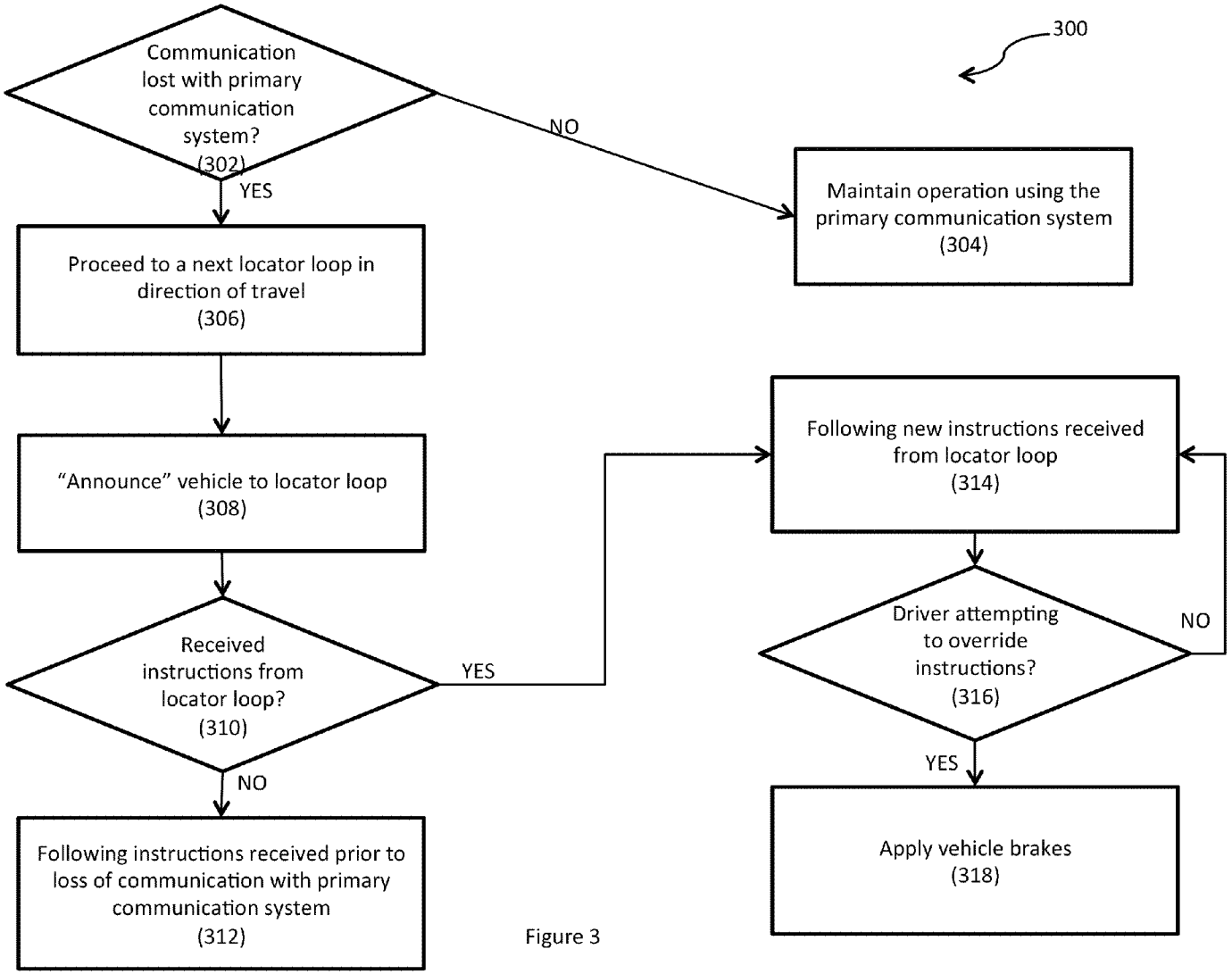
FIG. 3 is a flow chart of a method of using a locator loop control system in accordance with one or more embodiments.

FIG. 3 is a flow chart of a method 300 of using a locator loop control system in accordance with one or more embodiments. Method 300 begins with operation 302 in which a VOBC determines whether communication with a primary communication system is lost. In some embodiments, the VOBC determines communication is lost based on detecting a failure in a hardware item connected to the VOBC. In some embodiments, the VOBC determines communication is lost based on failure to receive a signal from the primary communication system for a pre-determined amount of time. In some embodiments, the primary communication system is a central control system, e.g., central control 116 (FIG. 1), or a wayside controller, e.g., wayside controller 114.

If the VOBC determines communication with the primary communication system is not lost, the VOBC continues to operation using information received from the primary communication system, in operation 304.

If the VOBC determines communication with the primary communication system is lost the VOBC provides instructions to an automatic speed control on-board the vehicle to proceed to a next locator loop in a direction of travel of the vehicle, in operation 306. In some embodiments, a switch is between the vehicle and the next locator loop. The vehicle stops at the switch until additional instructions are received. The VOBC determines the next locator loop using a guideway database stored in the VOBC and a vehicle position stored in the VOBC. In some embodiments, if a distance between the stored vehicle position and the stored location of a the next locator loop exceeds a movement authority of the vehicle, VOBC signals the automatic speed control to brake the vehicle to a stop and method 300 is halted until authority to move to the next locator loop is received. In some embodiments where the limit of movement authority from the primary communication system is less than a distance to the next locator loop, the VOBC causes the vehicle to brake to a stop until an on-board driver or a remote driver is able to direct the vehicle to the next locator loop to receive additional instructions.

In operation 308, the VOBC "announces" the vehicle to the locator loop. The VOBC "announces" the vehicle by transmitting vehicle identification information and position information stored on the VOBC. In some embodiments, the VOBC "announces" the vehicle using a coded frequency specific to the locator loop, which is stored on the VOBC. Following the "announcing," the locator loop is able to send movement instructions to VOBC for the vehicle.

In operation 310, the VOBC determines whether instructions were received from the locator loop. In some instances, if the vehicle is traveling too fast, the VOBC does not have sufficient time to receive instructions from the locator loop. In some instances, if communication with the primary communication system is lost just prior to passing the next locator loop, the locator loop does not have sufficient time to receive instructions from a wayside controller or another control system.

If the VOBC determines that no instructions were received from the locator loop, method 300 continues with operation 312 in which the VOBC facilitates operation of the vehicle based on instructions received from the primary communication system prior to the loss of communication. In some embodiments, the VOBC stores at least the latest instructions received from the primary communication system so the VOBC is able to continue executing the stored instructions up to a stored limit of movement authority. In some embodiments, the VOBC causes the vehicle to brake to a stop upon loss of communication with the primary communication system. In some embodiments, the vehicle remains stopped until an on-board driver or a remote driver is able to operate the vehicle to a next locator loop.

If the VOBC determines that instructions were received from the locator loop, method 300 continues with operation 314 in which the VOBC facilitates operation of the vehicle based on the instructions received from the locator loop. The VOBC is able to control the speed of the vehicle by sending signals to the automatic speed control.

In operation 316, the VOBC determines whether a driver if present is attempting to override the instructions received from the locator loop. The VOBC is able to determine whether the driver is attempting to override instructions by monitoring the vehicle position and the speed of the vehicle and comparing those values with the stored instructions from the locator loop.

If the VOBC determines the driver is attempting to override the instructions, the VOBC sends a signal to the automatic speed control to brake the vehicle to a stop, in operation 318.

If the VOBC determines the driver is complying with the instructions, method 300 continues with operation 314 in which the instructions from the locator loop are followed.

One of ordinary skill in the art would recognize that method 300 includes additional or different steps in different embodiments. For example, the VOBC controls the automatic speed control to reduce a speed of the vehicle following detection of a proximity plate, in some embodiments.

Figure 4:
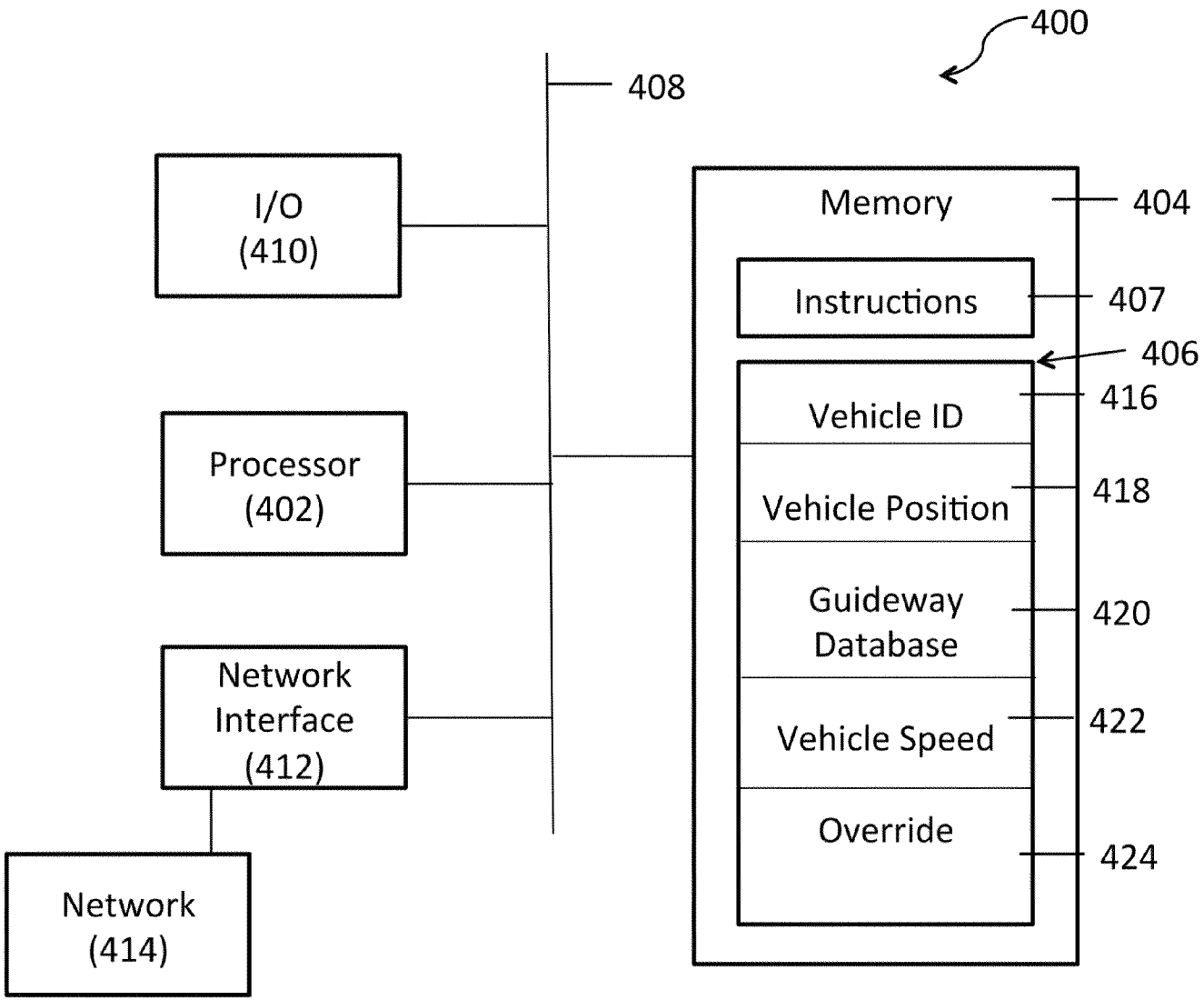
FIG. 4 is a block diagram of a vital on-board controller (VOBC) configured to use a locator loop control system in accordance with one or more embodiments.

FIG. 4 is a block diagram of a vital on-board controller (VOBC) 400 configured to use a locator loop control system in accordance with one or more embodiments. In some embodiments, VOBC 400 is similar to VOBC 104 (FIG. 1). VOBC 400 includes a hardware processor 402 and a non-transitory, computer readable storage medium 404 encoded with, i.e., storing, the computer program code 406, i.e., a set of executable instructions. Computer readable storage medium 404 is also encoded with instructions 407 for interfacing with elements of VOBC 400. The processor 402 is electrically coupled to the computer readable storage medium 404 via a bus 408. The processor 402 is also electrically coupled to an I/O interface 410 by bus 408. A network interface 412 is also electrically connected to the processor 402 via bus 408. Network interface 412 is connected to a network 414, so that processor 402 and computer readable storage medium 404 are capable of connecting and communicating to external elements, e.g., locator loop 108 (FIG. 1) or a primary communication system such as wayside controller 114 or central control 116, via network 414. In some embodiments, network interface 412 is replaced with a different communication path such as optical communication, microwave communication, inductive loop communication, or other suitable communication paths. The processor 402 is configured to execute the computer program code 406 encoded in the computer readable storage medium 404 in order to cause VOBC 400 to be usable for performing a portion or all of the operations as described with respect to locator loop control system 100 (FIG. 1) or a method 300 (FIG. 3).

In some embodiments, the processor 402 is a central processing unit (CPU), a multi-processor, a distributed processing system, an application specific integrated circuit (ASIC), and/or a suitable processing unit. In some embodiments, processor 402 is configured to generate position information signals for transmitting to external circuitry via network interface 412. In some embodiments, processor 402 is configured to receive instructions from a locator loop via network interface 412.

In some embodiments, the computer readable storage medium 404 is an electronic, magnetic, optical, electromagnetic, infrared, and/or a semiconductor system (or apparatus or device). For example, the computer readable storage medium 404 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 404 includes a compact disk-read only memory (CD-ROM), a compact disk-read/write (CD-R/W), and/or a digital video disc (DVD). In some embodiments, the computer readable storage medium 404 is part of an embedded microcontroller or a system on chip (SoC).

In some embodiments, the storage medium 404 stores the computer program code 406 configured to cause VOBC 400 to perform the operations as described with respect to locator loop control system 100 (FIG. 1) or method 300 (FIG. 3). In some embodiments, the storage medium 404 also stores information needed for performing the operations as described with respect to locator loop control system 100, such as a vehicle ID parameter 416, a vehicle position parameter 418, a guideway database parameter 420, a vehicle speed parameter 422, an override parameter 424 and/or a set of executable instructions to perform the operation as described with respect to locator loop control system 100.

In some embodiments, the storage medium 404 stores instructions 407 for interfacing with external components. The instructions 407 enable processor 402 to generate operating instructions readable by the external components to effectively implement the operations as described with respect to locator loop control system 100.

VOBC 400 includes I/O interface 410. I/O interface 410 is coupled to external circuitry. In some embodiments, I/O interface 410 is configured to receive instructions from a port in an embedded controller.

VOBC 400 also includes network interface 412 coupled to the processor 402. Network interface 412 allows VOBC 400 to communicate with network 414, to which one or more other computer systems are connected. Network interface 412 includes wireless network interfaces such as BLUETOOTH, WIFI, WIMAX, GPRS, or WCDMA; or wired network interface such as ETHERNET, USB, IEEE-1394, or asynchronous or synchronous communications links, such as RS485, CAN or HDLC. In some embodiments, the operations as described with respect to VOBC 400 are implemented in two or more position determining systems, and information such as position, first distance, second distance, vehicle speed, emitted wavelength and heading are exchanged between different VOBC 400 via network 414.

VOBC 400 is configured to receive information related to a vehicle ID from a user or a central control, e.g., central control 116 (FIG. 1). The information is transferred to processor 402 via bus 408 and stored in computer readable medium 404 as vehicle ID parameter 416. VOBC 400 is configured to receive information related to the position from on-board position determining systems, wayside controller 114 (FIG. 1) or central control 116. The information is transferred to processor 402 via bus 408 to determine a position of the vehicle along the guideway. The position is then stored in computer readable medium 404 as vehicle position parameter 418. VOBC 400 is configured to receive information related to a guideway database from a user, a wayside controller, e.g., wayside controller 114, or a central control, e.g., central control 116. The information is transferred to processor 402 via bus 408 and stored in computer readable medium 404 as guideway database parameter 420. In some embodiments, processor 402 determines a speed of the vehicle along the guideway. In some embodiments, the speed is determined based on sensors, such as tachometers, or signals from external components. The speed is then stored in computer readable medium 404 as vehicle speed parameter 422. In some embodiments, processor 402 determines an override of instructions by a driver based on vehicle position parameter 418 or vehicle speed parameter 422. The information is transferred to processor 402 via bus 408 and stored in computer readable medium 404 as override parameter 424.

During operation, processor 402 executes a set of instructions to control movement of the vehicle along the guideway following loss of communication with the primary communication system.

One aspect of this description relates to a locator loop control system. The locator loop control system includes a guideway configured to define a travel path of a vehicle. The locator loop control system further includes a locator loop located along the guideway, the locator loop configured to exchange information with a vital on-board controller (VOBC) on-board the vehicle. The locator loop control system further includes a first proximity plate located along the guideway, the first proximity plate spaced a first distance along the guideway from the locator loop, and a wayside controller configured to communicate with the locator loop.

Another aspect of this description relates to a vital on-board controller (VOBC) for a vehicle on a guideway. The VOBC includes a processor and a non-transitory computer readable medium connected to the processor. The non-transitory computer readable medium is configured to store instructions for providing instructions to an automatic speed control of the vehicle to proceed to a locator loop following loss of communication with a primary communication system. The non-transitory computer readable medium is configured to store instructions for announcing the vehicle to the locator loop, and receiving movement instructions from the locator loop. The non-transitory computer readable medium is configured to store instructions for determining if a driver is attempting to override the received movement instructions, and providing instructions to the automatic speed control to apply brakes of the vehicle if the driver is attempting to override the received movement instructions.

Still another aspect of this description relates to a method of using a locator loop control system. The method includes announcing a vehicle to a locator loop upon losing communication with a primary communication system. The method further includes receiving movement instructions from the locator loop, determining if a driver is attempting to override the received movement instructions, and applying brakes of the vehicle if the driver is attempting to override the received movement instructions.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A locator loop control system comprising:

a guideway configured to define a travel path of a vehicle;

a locator loop located along the guideway, the locator loop configured to exchange information with a vital on-board controller (VOBC) on-board the vehicle;

a first proximity plate located along the guideway, the first proximity plate spaced a first distance along the guideway from the locator loop; and a wayside controller configured to communicate with the locator loop.

2. The locator loop control system of claim 1, wherein the first distance along the guideway ranges from about 3 meters (m) to about 4 m.

3. The locator loop control system of claim 1, further comprising a second proximity plate located along the guideway, wherein the second proximity plate located on a downstream side of the locator loop from the first proximity plate, and the second proximity sensor is spaced from the locator loop by a second distance along the guideway.

4. The locator loop control system of claim 1, further comprising a central control configured to communicate with the wayside controller, wherein the central control is configured to provide movement instructions for the vehicle through the locator loop.

5. The locator loop control system of claim 1, wherein the proximity plate and the locator loop are positioned with respect to the guideway to be aligned with an antenna of the vehicle.

6. The locator loop control system of claim 1, wherein the wayside controller is configured to provide limit of movement authority, maximum vehicle speed, and distance to a next locator loop to the VOBC through the locator loop.

7. A vital on-board controller (VOBC) for a vehicle on a guideway comprising:

a processor; and a non-transitory computer readable medium connected to the processor, wherein the non-transitory computer readable medium is configured to store instructions for:

providing instructions to an automatic speed control of the vehicle to proceed to a locator loop following loss of communication with a primary communication system;

announcing the vehicle to the locator loop;

receiving movement instructions from the locator loop;

determining if a driver is attempting to override the received movement instructions; and providing instructions to the automatic speed control to apply brakes of the vehicle if the driver is attempting to override the received movement instructions.

8. The VOBC of claim 7, wherein the movement instructions comprise a limit of movement authority, a maximum vehicle speed, and a distance to a next locator loop along the guideway.

9. The VOBC of claim 7, wherein the non-transitory computer readable medium is configured to store movement instructions from the primary communication system, and instructions for:

providing instructions to the automatic speed control to follow the movement instructions from the primary communication system if no movement instructions are received from the locator loop.

10. The VOBC of claim 7, wherein the non-transitory computer readable medium is configured to store a guideway database, wherein the guideway database includes a location of each locator loop along the guideway.

11. The VOBC of claim 10, wherein the guideway database further includes a coded frequency for each locator loop along the guideway, and the non-transitory computer readable medium is configured to store instructions for: announcing the vehicle to the locator loop using the coded frequency for the locator loop.

12. The VOBC of claim 7, wherein the non-transitory computer readable medium is configured to store instructions for:

detecting a proximity plate prior to announcing the vehicle to the locator loop.

13. The VOBC of claim 12, wherein the non-transitory computer readable medium is configured to store instructions for:

providing instructions to the automatic speed control to decrease a speed of the vehicle following detection of the proximity plate.

14. The VOBC of claim 7, further comprising a network interface configured to facilitate communication between at least one of the locator loop, a wayside controller or a central control.

15. The VOBC of claim 7, wherein the non-transitory computer readable medium is configured to store instructions for:

communicating the instructions received from the locator loop to the driver.

16. A method of using a locator loop control system, the method comprises:

announcing a vehicle to a locator loop upon losing communication with a primary communication system;

receiving movement instructions from the locator loop;

determining, using a processor, if a driver is attempting to override the received movement instructions; and applying brakes of the vehicle if the driver is attempting to override the received movement instructions.

17. The method of claim 16, wherein receiving the movement instructions comprises receiving a limit of movement authority, a maximum vehicle speed, and a distance to a next locator loop along the guideway.

18. The method of claim 16, wherein announcing the vehicle comprises providing vehicle identification and vehicle position information to the locator loop.

19. The method of claim 16, further comprising detecting a proximity plate prior to announcing the vehicle to the locator loop.

20. The method of claim 19, further comprising reducing a speed of the vehicle following detection of the proximity plate.

* * * * *